US005628376A

United States Patent [19]

Kleine

[11] Patent Number: 5,628,376

[45] Date of Patent: May 13, 1997

[54] DRILLING TOOL BIT WITH A CARRIER MEMBER AND CUTTER MEMBERS

[75] Inventor: Werner Kleine, Achim, Germany

[73] Assignee: Hilti Aktiengesellschaft, Schaan Furstentum, Liechtenstein

[21] Appl. No.: 534,536

[22] Filed: Sep. 27, 1995

[30] Foreign Application Priority Data

Oct. 15, 1994 [DE] Germany ..... 44 36 916.6

[51] Int. Cl.[6] ..... E21B 10/48; E21B 10/58

[52] U.S. Cl. ..... 175/403; 175/420.1; 175/426

[58] Field of Search ..... 175/426, 427, 175/435, 420.1, 420, 420.2, 403, 405, 414, 421

[56] References Cited

U.S. PATENT DOCUMENTS

| | | | |
|---|---|---|---|
| 1,112,498 | 10/1914 | Van Es | 175/403 |
| 1,204,805 | 11/1916 | MacDonald | 175/426 |
| 2,998,086 | 8/1961 | Demo | 175/405 |

FOREIGN PATENT DOCUMENTS

| | | | |
|---|---|---|---|
| 889080 | 12/1943 | France | 175/426 |
| 385938 | 12/1923 | Germany | 175/426 |
| 800853 | 12/1950 | Germany | 175/420.1 |
| 829913 | 5/1981 | Russian Federation | 175/403 |
| 18443 | 8/1913 | United Kingdom | 175/420.1 |

*Primary Examiner*—Hoang C. Dang
*Attorney, Agent, or Firm*—Anderson Kill & Olick P.C.

[57] ABSTRACT

A drilling bit includes a carrier member (3) shaped, for instance, as a hollow annular crown. In such a crown several cutter members (4) are distributed angularly apart around the circumferentially extending leading end of the carrier member. The cutter members (4) project both radially outwardly and inwardly from the wall thickness of the carrier member. A step (S) is formed in the cutter members spaced from the leading end thereof opposite of the drilling direction. The step (S) is located at the trailing end of a region (K) with a continuous reduction in the radial dimension (R) of the cutter member and the radial dimension is further reduced at the step. Due to the further reduction in the radial dimension at the step (S), the length of the cutter member (4) in the drilling direction, causing friction with the wall surface of the borehole to be drilled, is limited after extended use of the drilling bit, so that the drilling bit retains a higher drilling efficiency even after such extended use.

6 Claims, 1 Drawing Sheet

DRILLING TOOL BIT WITH A CARRIER MEMBER AND CUTTER MEMBERS

BACKGROUND OF THE INVENTION

The invention is directed to a drilling tool bit with a carrier member and at least one cutter member where its radial dimension diminishes continuously in the direction opposite to the drilling direction and the cutter member extends radially outwardly and axially from the circumferential surface of the carrier member.

Drilling tool bits of the above type serve for drilling rock, concrete, masonry and similar materials. The carrier members can be differently shaped. It is common, however, to all drilling tool bits that they have one or more cutter members located at the leading end of the bit wherein these cutter members are formed of wear-resistant material, such as hard metal or alloy, mechanically resistant metal, or the like.

The carrier member can be in the form of an axially extending shank with a helix extending around its circumferential surface, and the helix can be molded as one piece with the shank or it can be connected to it. Cutter members project outwardly from the carrier member radially as well as axially in the drilling direction and as an example, a single cutter member can be used for smaller diameter carrier members and several cutter members can be used for larger diameter carrier members. As an example, a drilling tool bit, in particular for a larger diameter, is disclosed in DE-PS 25 43 578.

Further, it is possible, especially for drilling boreholes of larger diameter, to use a hollow annular carrier member. In such an arrangement, the cutter members project axially as well as radially outwardly in the drilling direction from the leading end of the carrier member, with the cutter members being spaced angularly apart around the circumference of the carrier member. The length of the cutter members in the drilling direction must not be less than a minimum dimension, so that a sufficiently large contact surface exists between the cutter member and the carrier member, such a hollow annular drilling bit is known in DE-PS 24 19 548.

It is common in such cutter members that the radial dimension diminishes continuously opposite to the drilling direction, as the previously mentioned drilling tool bit demonstrates. Accordingly, in the case of a hollow annular drilling bit used as a carrier member, the width of the cutter members measured in the radial direction opposite to the drilling direction reduces continuously towards the inner as well as the outer surface of the carrier member. By such reduction in the radial dimension of the cutter members, it is possible to reduce the friction of the cutter members against the borehole wall surface.

As long as the drilling bits are new, the reduction in friction is achieved. The longer the drill bits are in use, however, the more the radially measured dimension of the cutter members approaches a constant dimension due to wear. Accordingly, the surface of the cutter members producing friction opposite to the drilling direction in contact with the wall surface of the bore hole being drilled increases and the efficiency of the drill bit is considerably reduced because of the continuous increase in friction. In the extreme case, the surface of the cutter member producing friction against the wall surface of the borehole being formed extends for its entire axial length, that is, for the length of the cutter members embedded in the carrier member. As a result, this leads to an overload on the drilling bit and causes jamming of the bit in the borehole being formed.

These problems are further worsened in the case of solid drilling bits with more than one cutter member which have come into increased use in recent years. Such drilling bits produce circular holes with closer tolerances than has been known in the past when utilizing drilling bits equipped with a single cutter member. The jamming effect due to the wear phenomenon explained above is particularly acute, so that the pertinent problems are intensified. This set of problems appears in an equally undesirable manner also with drilling bits whose carrier member is configured as a hollow annular drill bit with several cutter members, since such drilling bits produce boreholes also with close tolerances.

SUMMARY OF THE INVENTION

Therefore, the primary object of the present invention is to provide a drilling bit where the friction of the cutter members at the surface of the borehole to be produced is not increased in a manner reducing drilling efficiency, even with extended use.

In accordance with the present invention, the radial dimension of the cutter members is reduced opposite to the drilling direction in a continuous manner and then is further reduced in a single step.

The reduction in the radial dimension of the cutter members in the form of a step leads to a sort of waist-like appearance of the cutter members. As a result, even after extended use of the drilling bits, the axial length of the cutter members, causing friction against the wall surface of the borehole being produced, extends only to the step and not beyond. Accordingly, a permissible maximum amount of friction is not exceeded independent of the duration of the use of the drilling bits.

Even with drilling bits according to the present invention, friction increases by a certain amount with continued use. The maximum value of the friction, however, can be limited so that the friction does not cause any reduction in efficiency. The maximum value depends on selecting the location of the step and it has been shown that preferred values are attained when the dimension from the leading end of the cutter member to the step, measured in the axial direction, is in the range of 0.3 to 0.5 times the full axial length of the cutter members. Independently of the design of the carrier member, it is advantageous if the step is located in the region of the leading end of the carrier member.

Apart from the design of the carrier member, it is advantageous if the step is located in the region of the leading end of the carrier member. This assures that the region projecting in the axial direction assists to a maximum in determining the length governing the friction. The axial region in which the cutter members are embedded in the carrier member does not lead to any impermissible increase in the friction of the drilling bit with the surface of the borehole being formed.

To assure that the axially extending region of the cutting members extending rearwardly from the step, that is opposite to the drilling direction, does not participate in developing friction, an adequate reduction in the radial dimension of the cutter members is provided. This is achieved if the radial dimension of the cutter members is reduced in a preferred manner by at least 30 percent of the dimension by which the cutter members project radially immediately ahead of the step. This means that the width of the cutting members adjacent to the step, measured in the radial direction, can be reduced at a maximum to the outside surface of carrier member.

Preferably, for a symmetrical arrangement of the cutter members, the radial dimension of the cutter member is reduced at both sides by a step.

It is preferable in forming bore holes of larger diameter that the carrier member is in the form of a hollow annular member as pointed out above.

The waist-like shape of the cutter member of the present invention results in the advantages named above where the cutter members are spaced angularly apart around the leading end face of the annular carrier member. Accordingly, in another embodiment of the invention, the carrier member is a hollow annular member where the radial dimension of the cutter members is reduced from the leading end up to the step and then is reduced further inwardly at both the inner anal outer axially extending surfaces of the carrier member. In such an arrangement the cutter members are preferably arranged symmetrically, meaning that the width of the cutter members measured in the radial direction diminishes at both wide sides in a step. Accordingly, the step coincides with the leading end of the carrier member. In addition to the mentioned advantages, the removal of the drilling core is considerably improved by the design according to the present invention.

DETAILED DESCRIPTION OF THE INVENTION

Figure 1:
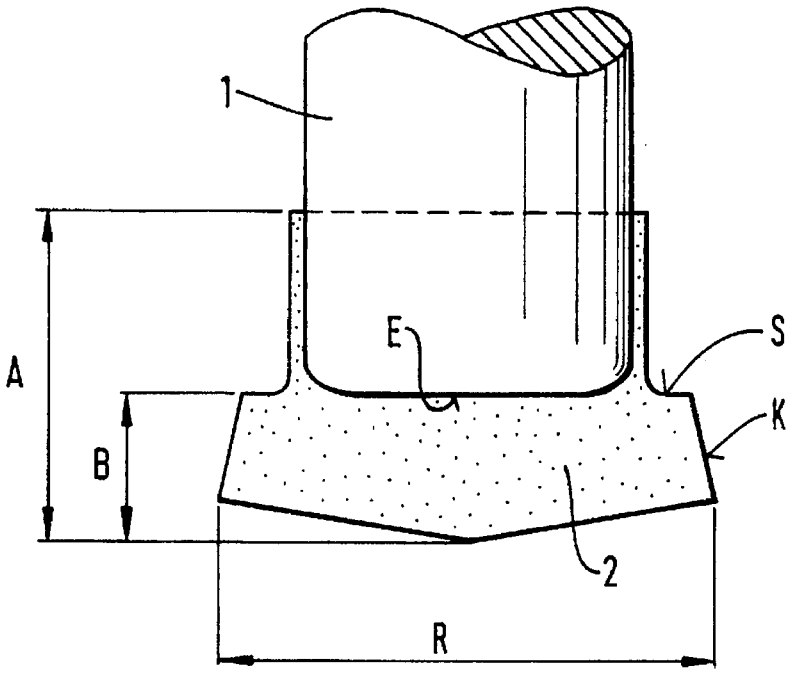
FIG. 1 is an axially extending view of the leading end of a drilling bit embodying the present invention.

In FIG. 1 a drilling bit is shown formed of a carrier member 1 and a cutter member 2. The cutter member 2 is embedded in the carrier member 1. In FIG. 1 only the leading end of the drilling bit is shown. The carrier member 1 has an axial direction with the dimension R of the cutter member shown extending transversely of the axial or drilling direction of the bit.

As shown in FIG. 1 the dimension R of the cutter member 2, measured in the radial direction relative to the axial direction of the carrier member 1, diminishes continuously in the region K up to an inwardly directed step S. The step S effects an additional reduction in the radial width R of the cutter member 2. As shown in FIG. 1, the step S coincides substantially with the leading end E of the carrier member 1. The cutter member 2 projects by the dimension B from the leading end E of the carrier member 1, while the overall axial length of the cutter member 2 corresponds to the dimension A.

Figure 2:
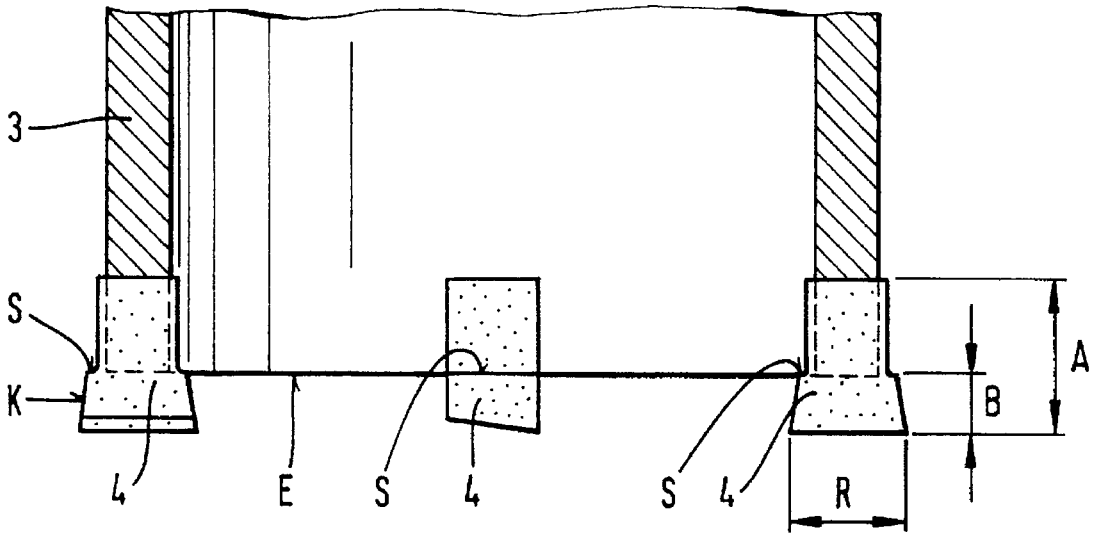
FIG. 2 is a view similar to FIG. 1 showing the leading end of a drilling bit with a hollow annular carrier member.

In FIG. 2 the drilling bit includes a hollow annular crown forming the carrier member 3 in which the cutter members 4 are embedded. The cutter members 4 are spaced angularly apart around the leading ends of the carrier member 3, and extend axially outwardly from the leading end E of the carrier member 3 and also transversely or radially beyond the inner and outer surfaces of the carrier member 3. As illustrated in FIG. 2, the radial width R of the cutting members 4 reduces or diminishes continuously in the region K up to a step S. In an extreme case the outward projection of the cutter members 2,4 can be eliminated so that their radical dimension corresponds to the dimension of the carrier members 1, 3 and in the case of a hollow annular drilling bit they would correspond to the wall thickness of the carrier member.

While specific embodiments of the invention have been shown and described in detail to illustrate the inventive principles, it will be understood that the invention may be embodied otherwise without departing from such principles.

I claim:

1. A drilling bit having a drilling direction and comprising an axially extending carrier member (1, 3) having a leading end facing in the drilling direction and at least one cutter member (2, 4) located at the leading end of said carrier member and having a leading end with a dimension (R) extending transversely of the drilling direction of said carrier member and an axially extending region (K) extending from the leading end with a continuously diminishing transverse dimension in the direction opposite to the drilling direction to a trailing end thereof, said cutter member having an axially extending trailing end region embedded in said carrier member and an axial length (A) between the leading and trailing ends thereof, said at least one cutter member projects in the drilling direction and in the radial direction from the leading end of said carrier member, said at least one cutter member has a radially inwardly directed step (S) at the trailing end of said region (K), said cutter member between said step and the trailing end thereof having a dimension transverse of the drilling direction at least equal to the corresponding transverse dimension of said carrier member in which said cutter member is embedded.

2. A drilling bit, as set forth in claim 1, wherein said at least one cutter member (2,4) has an axial dimension (B) extending from the leading end thereof to the step (S) corresponding approximately to 0.3 to 0.5 times the full axial length (A) of said at least one cutter member.

3. A drilling bit, as set forth in claim 1 or 2, wherein the step (S) is located in the region of the leading end (E) of said carrier member (1, 3).

4. A drilling bit, as set forth in claim 1 or 2, wherein the radial dimension of said at least one cutter member (2, 4) is reduced at the step (S) by at least 30 percent of the dimension of said cutter member immediately preceding said step towards the leading end thereof.

5. A drilling bit, as set forth in claim 4, wherein said at least one cutter member (2, 4) having two opposite sides spaced in the radial direction thereof extending outwardly from said carrier member with said step located at each of said sides.

6. A drilling bit, as set forth in claim 1 or 2, wherein said carrier member (3) is a hollow annular crown with angularly spaced apart said cutter members and the radial dimension (R) of said cutter members (4) diminishes opposite to the drilling direction to said step (S) located at the trailing end of the continuously reduced axially extending region (K) of said cutter members and said cutter members project radially outwardly from an inside surface and an outside surface of said carrier member (3).

* * * * *